US006544080B1

(12) United States Patent
Yamamoto

(10) Patent No.: US 6,544,080 B1
(45) Date of Patent: Apr. 8, 2003

(54) TERMINAL

(75) Inventor: Hiroshi Yamamoto, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/575,647

(22) Filed: May 31, 2000

(30) Foreign Application Priority Data

Jun. 17, 1999 (JP) ..... 11-171408

(51) Int. Cl.[7] ..... H01R 11/22
(52) U.S. Cl. ..... 439/849; 439/852
(58) Field of Search ..... 439/849, 852, 439/847, 843, 948, 442, 845, 848, 381

(56) References Cited

U.S. PATENT DOCUMENTS

| | | | | |
|---|---|---|---|---|
| 4,579,409 A | * | 4/1986 | Enneper et al. | |
| 5,601,458 A | * | 2/1997 | Ohsumi et al. | 439/852 |
| 5,722,925 A | * | 3/1998 | Kameyama et al. | 493/849 |
| 5,897,405 A | * | 4/1999 | Endo | 439/852 |
| 6,039,615 A | | 3/2000 | Suzuki | |
| 6,095,873 A | * | 8/2000 | Muramatsu et al. | 439/852 |
| 6,116,970 A | | 9/2000 | Yamamoto et al. | |
| 6,139,376 A | * | 10/2000 | Ooya et al. | 439/843 |

FOREIGN PATENT DOCUMENTS

| | | |
|---|---|---|
| JP | 09035813 | 2/1997 |
| JP | 11-214058 | 8/1999 |

OTHER PUBLICATIONS

09/594,813, Hiroshi Yamamoto, Jun. 6, 2000.

* cited by examiner

*Primary Examiner*—Renee Luebke
*Assistant Examiner*—Phuongchi Nguyen
(74) *Attorney, Agent, or Firm*—Finnegan, Henderson, Farabow, Garrett & Dunner, L.L.P.

(57) ABSTRACT

A terminal has a bottom wall, a pair of side walls, an upper wall, an elastic contact portion that is freely elastically deformable in a direction substantially vertical with respect to the bottom wall, an elastic receiving surface portion that opposes the elastic contact portion, an engaging/retaining portion on the bottom wall that is freely displaceable by its elastic deformation made in a direction substantially vertical with respect to the bottom wall, and a stopper. The side walls respectively rise from both ends of the bottom wall. The upper wall extends from at least one of the side walls to over the bottom wall and opposes the bottom wall. The elastic contact portion is provided on one of the bottom wall and the upper wall while the elastic receiving surface portion is provided on the other of them. The engaging/retaining portion is engaged with a mating terminal that is inserted between the elastic contact portion and the elastic receiving surface portion. The stopper is bent from the upper wall to thereby contact with the mating terminal and thereby prevent excessive insertion of the same.

3 Claims, 6 Drawing Sheets

TERMINAL

CROSS-REFERENCE TO RELATED APPLICATIONS

Not Applicable

STATEMENT REGARDING FEDERALLY SPONSORED RESEARCH

Not Applicable

REFERENCE TO A MICROFICHE APPENDIX

Not Applicable

BACKGROUND OF THE INVENTION

1. Description of Related Art

A conventional female terminal that is disclosed in Japanese Patent Application Laid-Open No. 9-35813 is equipped with a bottom wall, a pair of side walls that have been substantially vertically bent from the bottom wall 2, and upper walls that have been bent from upper ends of the side walls so as to become parallel with the bottom wall. A part of the upper wall is bent to form an elastic contact portion while a part of the bottom wall is bent to form an elastic receiving surface portion opposing the elastic contact portion. An engaging/retaining protruding portion is formed on the elastic receiving surface portion, on a free-end side of that there is formed a stopper by bending it. At a position upper than the stopper there is provided an operation portion that protrudes more upwardly than the upper wall.

When a male terminal is inserted into between the elastic contact portion and the elastic receiving surf ace portion, the elastic contact portion is elastically deformed upward. As a result of this, the insertion of the male terminal is permitted. When the position of the engaging/retaining hole of the male terminal reaches the position of the engaging/retaining protruding portion by insertion, the engaging/retaining portion is engaged with and retained by the engaging/retaining hole of the male terminal by the elasticity of the elastic contact portion, etc. Also, when the male terminal is further inserted from this state, the forward end surface of the male terminal abuts on the stopper. This keeps the male terminal from its excessive insertion.

When in a state where the male terminal and the female terminal are mounted together an external force has acted upon the male terminal in a direction drawing it off from the female terminal, the draw-off of the male terminal does not occur and the mounted state is maintained as is. This is because the engaging/retaining protruding portion of the female terminal is kept in engagement and retention with the engaging/ retaining hole of the male terminal.

Also, when unlocking the male terminal from the female terminal, the operation portion of the female terminal is depressed downward. As a result of this, the elastic receiving surf ace portion is downwardly elastically deformed, with the result that the engaging/retaining protruding portion is unlocked from the engaging/retaining hole of the male terminal. If, in this unlocked condition, the male terminal is drawn off from the female terminal, the male terminal gets easily disengaged from the female terminal.

2. Field of the Invention

The present invention relates to a terminal structure having an engagement/retention portion that is engaged with and retained by an engagement/retention portion to be engaged and retained of a mating terminal to be inserted.

SUMMARY OF THE INVENTION

However, in the above-described terminal, when the forward end surface of the male terminal is in contact with the stopper, it is not possible to easily perform the drawing-off operation of the male terminal. The reason for this is as follows. Because the male terminal is in abutment with the stopper, the stopper is hard to displace downward. For this reason, the elastic receiving surface portion is not sufficiently elastically deformed downward and so the engaging/retaining protruding portion is not unlocked from the engaging/retaining hole of the male terminal.

Thereupon, an object of the present invention is to provide a terminal that can prevent excessive insertion of a mating terminal by the stopper and in that the stopper does not become an obstacle to performing the drawing-off operation of a mating terminal.

To attain the above object, a terminal according to the present invention has a bottom wall, a pair of side walls, an upper wall, an elastic contact portion that is freely elastically deformable in a direction substantially vertical with respect to the bottom wall, an elastic receiving surf ace portion that opposes the elastic contact portion, an engaging/retaining portion on the bottom wall that is freely displaceable by its elastic deformation made in a direction substantially vertical with respect to the bottom wall, and a stopper. The side walls respectively rise from both ends of the bottom wall. The upper wall extends from at least one of the side walls to over the bottom wall and opposes the bottom wall. The elastic contact portion is provided on one of the bottom wall and the upper wall while the elastic receiving surface portion is provided on the other of them. The engaging/retaining portion is engaged with a mating terminal that is inserted between the elastic contact portion and the elastic receiving surface portion. The stopper is bent from the upper wall to thereby contact with the mating terminal and thereby prevent excessive insertion of the same.

According to the construction, when the mating terminal is inserted into between the elastic contact portion and the elastic receiving surface portion, the engaging/retaining portion is engaged with and retained by an engagement/retention portion to be engaged and retained of the mating terminal. When attempting to insert the mating terminal excessively, the mating terminal abuts on the stopper.

In a case where drawing off the mating terminal from the terminal, the method therefor is to disengage the engaging/retaining portion from the engagement/retention portion to be engaged and retained by some means or another. At this time, it is not necessary to displace the stopper.

In this way, it is possible to prevent excessive insertion of the mating terminal by the stopper and in addition the stopper does not become an obstacle to performing the drawing-off operation of the mating terminal. Accordingly, even when the forward end surface of the mating terminal is kept in abutment with the stopper, it is possible to draw off the mating terminal reliably.

The width of the stopper may be larger than the thickness thereof and the width direction of the stopper may be substantially the same as the direction in which the mating terminal is inserted.

According to the construction, the forward end surface of the male terminal abuts on the end surface of the stopper. And in addition the stopper receives the pressing force exerted from the mating terminal by its thickness as viewed in the direction of its width whose dimension is larger than that of the thickness of the stopper as otherwise viewed.

Therefore, the stopper is not easily displaced with respect to the pressing force exerted from the male terminal. Accordingly, even when the stopper receives a strong inserting force, the stopper reliably can prevent the excessive insertion of the male terminal. Also, even when the stopper receives a strong inserting force, the stopper is kept away from being deformed, etc.

The stopper may be extended obliquely toward the bottom wall.

According to the construction, the area of contact between the stopper and the male terminal becomes large. As a result of this, the pressing force per unit area that the member on each side receives becomes small and this can prevent the deformation, etc. of each member.

DESCRIPTION OF THE PREFERRED EMBODIMENTS

An embodiment of the present invention will now be explained with reference to the drawings.

Figure 1:
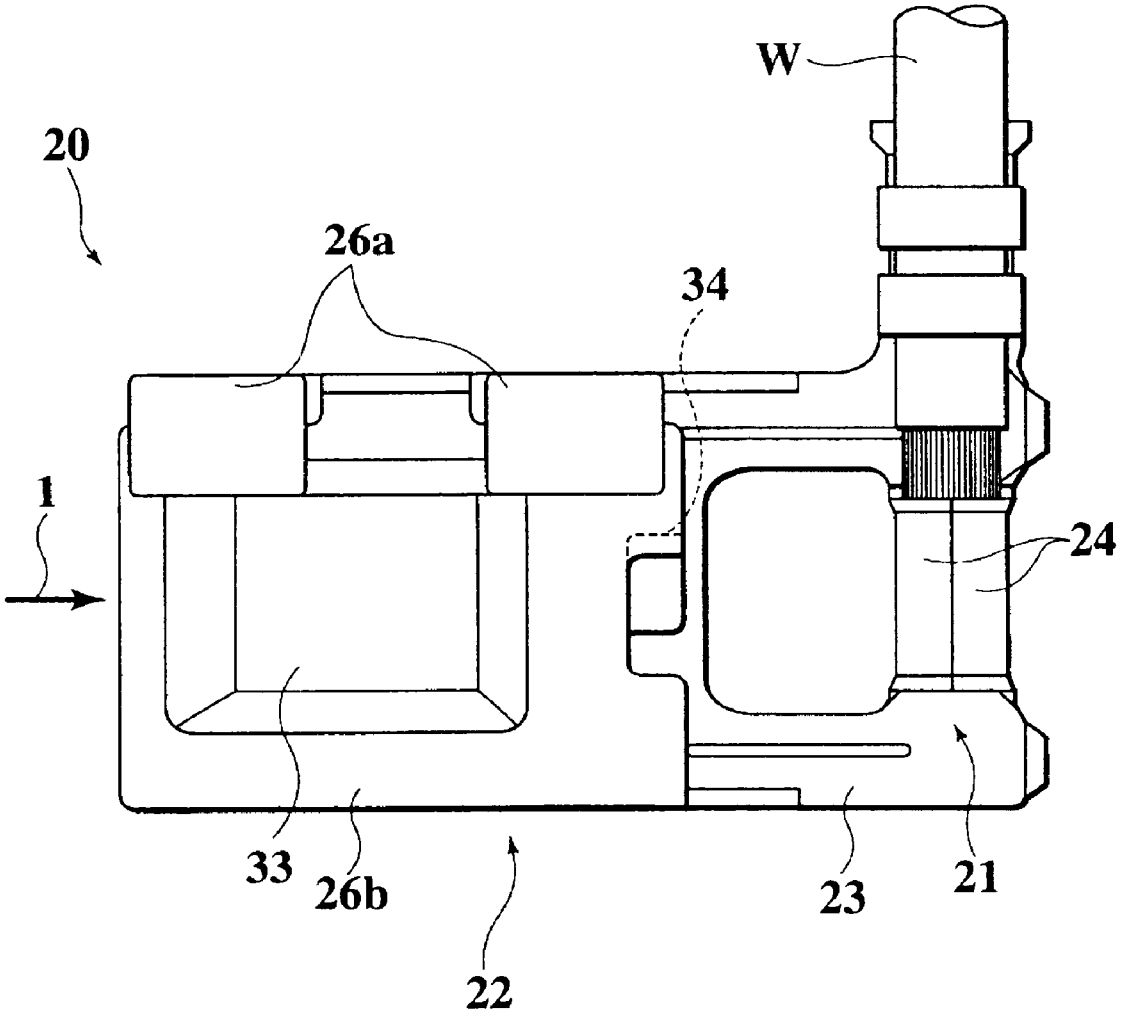
FIG. 1 is a plan view illustrating a female terminal according to an embodiment of the present invention.
Figure 2:
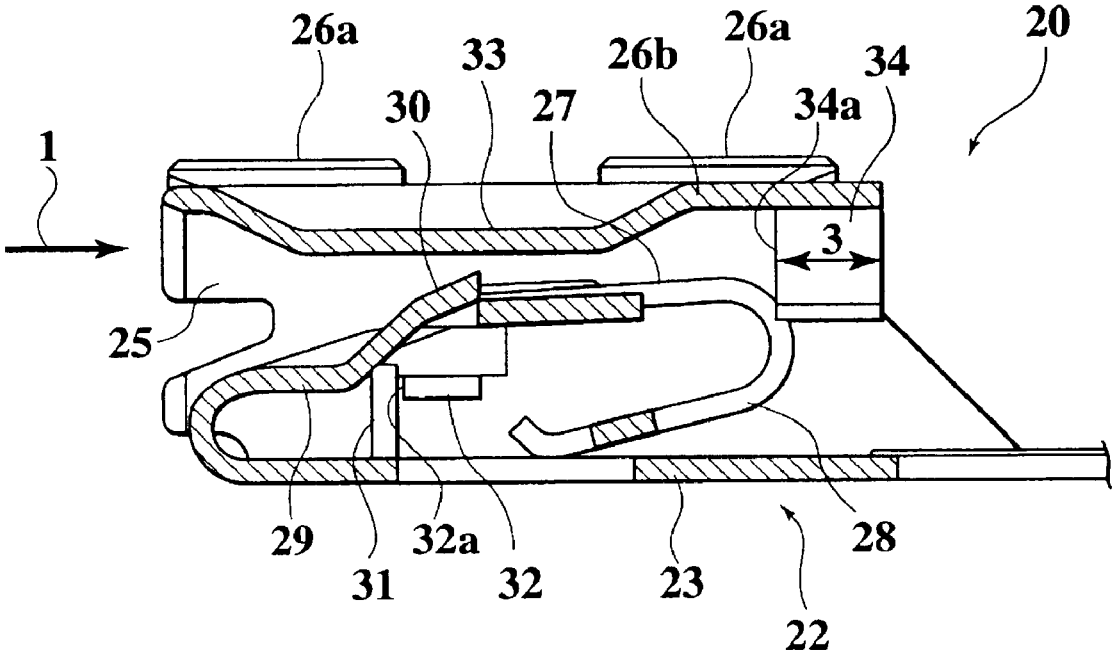
FIG. 2 is a sectional view illustrating the female terminal according to the embodiment of the present invention.
Figure 3:
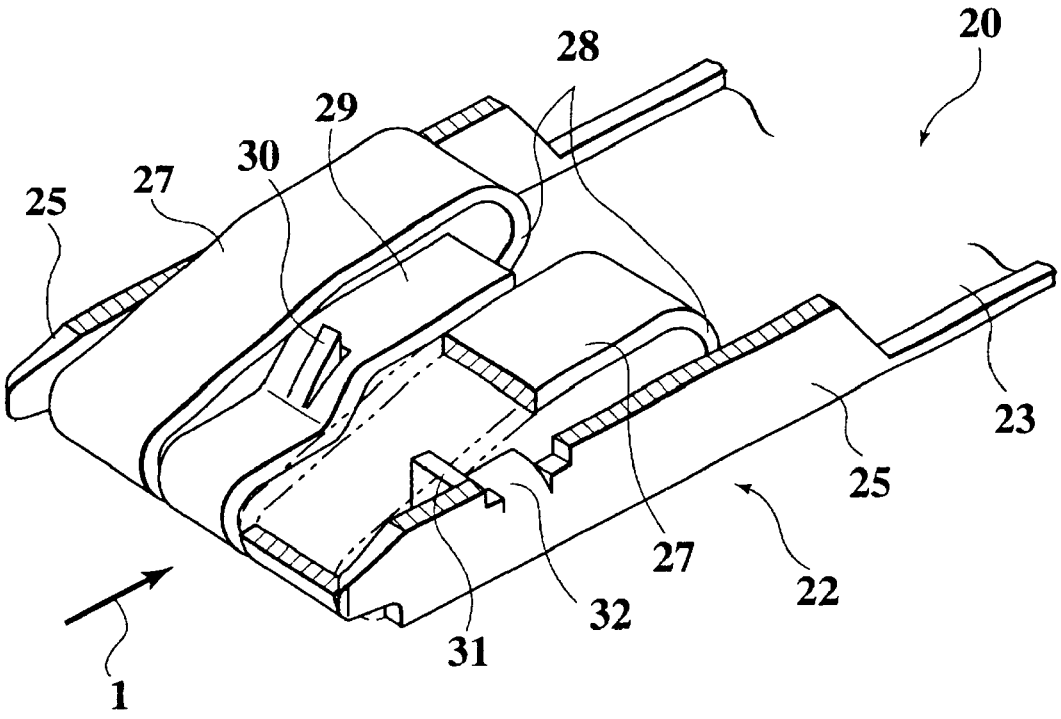
FIG. 3 is a perspective view illustrating a main part of the female terminal according to the embodiment of the present invention.
Figure 4:
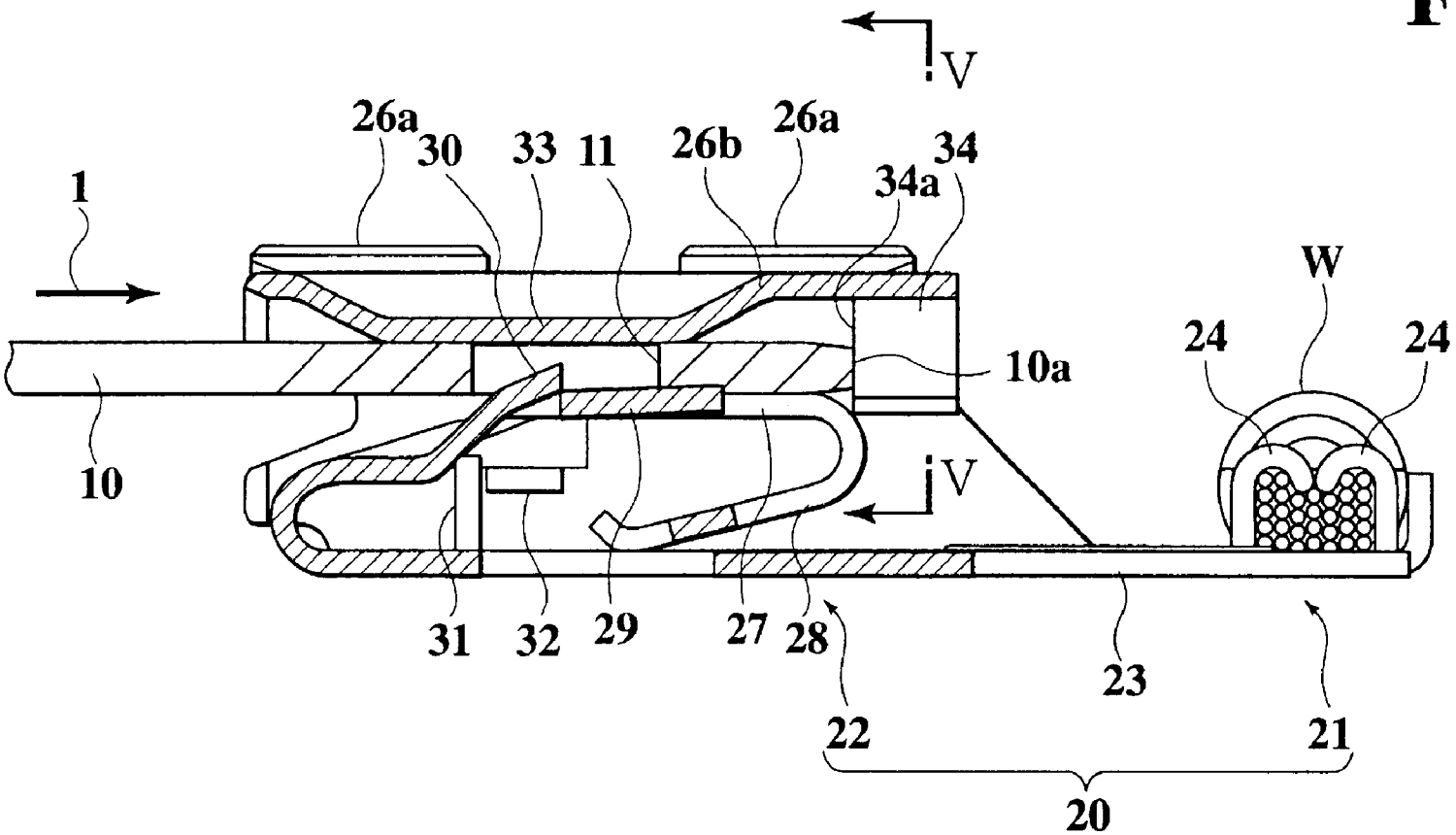
FIG. 4 is a sectional view illustrating a state where a male terminal has been inserted into the female terminal according to the embodiment of the present invention.

FIGS. 1 to 4 illustrate an embodiment of the present invention. FIG. 1 is a plan view of a female terminal; FIG. 2 is a sectional view thereof; FIG. 3 is a perspective view illustrating a main part of the female terminal; and FIG. 4 is a sectional view illustrating a state where a male terminal has been inserted into the female terminal.

In FIGS. 1 through 4, the female terminal 20 is integrally formed by being punched out from a single metal flat plate, and the female terminal 20 has an electric-wire-fastening portion 21 and a terminal contact portion 22. The electric-wire-fastening portion 21 has a bottom wall 23 and a pair of caulking pieces 24 that have been upwardly bent from each end of the bottom wall 23. An electric wire W that has been placed between a pair of the caulking pieces 24 is fastened by a pair of the caulking pieces 24.

The terminal contact portion 22 has a bottom wall 23 common to that of the electric-wire-fastening portion 21, a pair of side walls 25 substantially vertically bent from both ends of the bottom wall 23 respectively, and upper walls 26*a* and 26*b* respectively bent from upper ends of the side walls 25 to extend over the bottom wall 23.

On the bottom wall 23 there are provided three divided forward protruding portions.

The both-side forward protruding portions of these protruding portions are bent in such a way as to overlap the bottom wall 23 from over the same with some suitable space remaining therebetween. And as a result of this a pair of elastic contact portions 27 are constructed. A rear side of each elastic contact portion 27 is further bent in such a way as to enter into over the bottom wall 23, whereby an elastic reinforcing portion 28 is constructed. When the elastic contact portion 27 is downwardly displaced to some extent, that elastic reinforcing portion 28 abuts on the bottom wall 23, whereby the rein-forcing portion 28 itself also is elastically deformed. By the elastic deformation, the reinforcing portion 28 elastically reinforces the contact portion 27.

Also, a central forward protruding portion is bent in such a way as to overlap the bottom wall 23 from over the same with some suitable space remaining therebetween, too, whereby a central elastic-deformation portion 29 is constructed. On the central elastic-deformation portion 29 there is formed an engaging/retaining protruding portion 30 constituting an engaging/retaining portion by the portion 29 being partly bent. The engaging/retaining protruding portion 30 protrudes upward and is vertically displaced with elastic deformation of the central elastic-deformation portion 29. On a rear side of the central elastic-deformation portion 29 there is not provided an elastic reinforcing portion 28 such as that provided with respect to the elastic contact portion 27. As a result of this, the central elastic-deformation portion 29 is constructed so that the portion 29 may be subjected to easy, downward, elastic deformation.

Further, on the left and right sides of the bottom wall 23 there are respectively provided excessive-displacement-preventing piece portions 31 that are bent substantially in the vertical direction and that extend upward. Upper ends of the pair of excessive-displacement-preventing piece portions 31 are respectively situated in the vicinities of the undersides of forward portions of a pair of the elastic contact portions 27.

On a pair of side walls 25 there are respectively provided deformation-preventing stoppers 32 that are bent in directions each intersecting its corresponding side wall substantially at a right angle with respect thereto and that horizontally extend. Frontward end surfaces 32*a* of the pair of deformation-preventing stoppers 32 are respectively disposed in such a way as to substantially abut on the rear surfaces of upper end portions of a pair of the excessive-displacement-preventing piece portions 31.

Two upper walls 26*a* and 26*b* on both sides are disposed in such a way as to partly overlap each other, and the upper-side upper wall 26*a* regulates the upward displacement of the lower-side upper wall 26*b*. The lower-side upper wall 26*b* is partly bent downward to provide an elastic receiving surface portion 33. This elastic receiving surface portion 33 opposes the elastic contact portions 27 of the bottom wall 23. Also, on the lower-side upper wall 26*b* there is provided a stopper 34 that is bent downward. The width 3 (illustrated in FIG. 2) of the stopper 34 is set to be sufficiently larger than the thickness thereof. And the width direction of the stopper 34 is set to be substantially the same as the direction 1 in which a male terminal 10 is inserted. By this setting, the stopper 34 is provided so that an end surface 34*a* thereof may abut on a forward end surface 10*a* of the male terminal 10. Also, in this embodiment, the direction in which the stopper 34 is downwardly extended is set to be a vertical direction with respect to the lower-side upper wall 26*b*.

On the other hand, the male terminal 10 (illustrated in FIG. 4) that is a mating terminal is shaped like a flat rod. At a position that is somewhat distant from a forward end thereof toward a base end side, there is formed an engaging/retaining hole 11 that is an engagement/retention portion to be engaged and retained.

In the above-described construction, when the male terminal 10 (illustrated in FIG. 4) that is a mating terminal is inserted into between the elastic contact portion 27 and the elastic receiving surface portion 33, the elastic contact portion 27 and the central elastic-deformation portion 29 are elastically deformed downward. As a result of this, the insertion of the male terminal 10 is permitted. When the position of the engaging/retaining hole 11 of the male terminal 10 reaches the position of the engaging/retaining protruding portion 30 by insertion, the portion 30 is engaged with and retained by the engaging/retaining hole 11 of the male terminal 10 by the elasticity of the central elastic-deformation portion 29. Also, when the male terminal 10 is further inserted from this state, as illustrated in FIG. 4 the forward end 10*a* of the male terminal 10 abuts on the stopper 34. This keeps the male terminal 10 from 5 its excessive insertion.

Assume that the male terminal 10 and the female terminal 20 be in a state of their being mounted together. In this state, even when an external force acts to cause the draw-off of the male terminal 10 from the female terminal 20, the draw-off of the male terminal 10 is prevented. This is because the engaging/retaining protruding portion 30 of the female terminal 20 is kept in engagement and retention with the engaging/retaining hole 11 of the male terminal 10.

On the other hand, when regularly drawing off the male terminal 10 from the female terminal 20, an unlocking jig (not illustrated) is mounted on the female terminal 20. After that, the central elastic-deformation portion 29 is downwardly elastically deformed to unlock the engaging/retaining protruding portion 30 from the engaging/retaining hole 11 of the male terminal 10. Then, in the unlocked condition, the male terminal 10 may be drawn off from the female terminal 20.

Here, since at the time of unlocking the engaging/retaining protruding portion 30 from the engaging/retaining hole 11 there is no need to cause the displacement of the stopper 34, the following advantage comes up. Namely, even when the forward end surface 10*a* of the male terminal 10 is in abutment with the stopper 34 as illustrated in FIG. 4, the stopper 34 does not become an obstacle to performing the male-terminal-20-drawing-off operation. Accordingly, even when the forward end surface 10*a* of the male terminal 10 is in abutment with the stopper 34 as illustrated in FIG. 4, it is possible to draw-off the male terminal 10 from the female terminal 20 reliably.

Also, in this embodiment, the width dimension 3 of the stopper 34 is set to be larger than the dimension of the thickness thereof. In addition, the stopper 34 is set so that the width direction thereof may be substantially the same as the direction 1 in which the male terminal 10 is inserted. Therefore, excessive insertion causes the forward end surface 10*a* of the male terminal 10 to abut on the end surface 34*a* of the stopper 34. In other words, the forward end surface 10*a* of the male terminal 10 abuts on the end surface 34*a* of the stopper 34. And in addition the stopper 34 receives the pressing force by its thickness as viewed in the direction of its width whose dimension is larger than that of the thickness of the stopper 34 as otherwise viewed. Therefore, the stopper 34 is not easily displaced with respect to the pressing force exerted from the male terminal 10. Accordingly, even when the stopper 34 receives a strong inserting force, the stopper reliably can prevent the excessive insertion of the male terminal 10. Also, even when the stopper 34 receives a strong inserting force, the stopper 34 is kept away from being deformed, etc.

Figure 5:
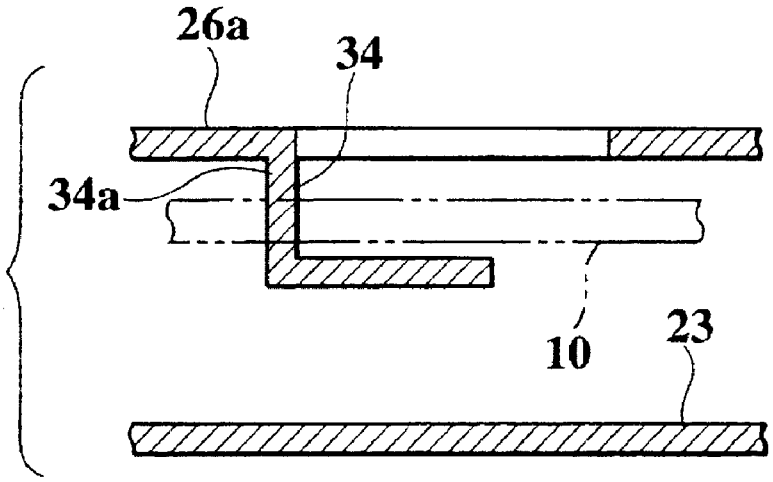
FIG. 5 is a sectional view taken along a line V—V of FIG. 4.
Figure 6:
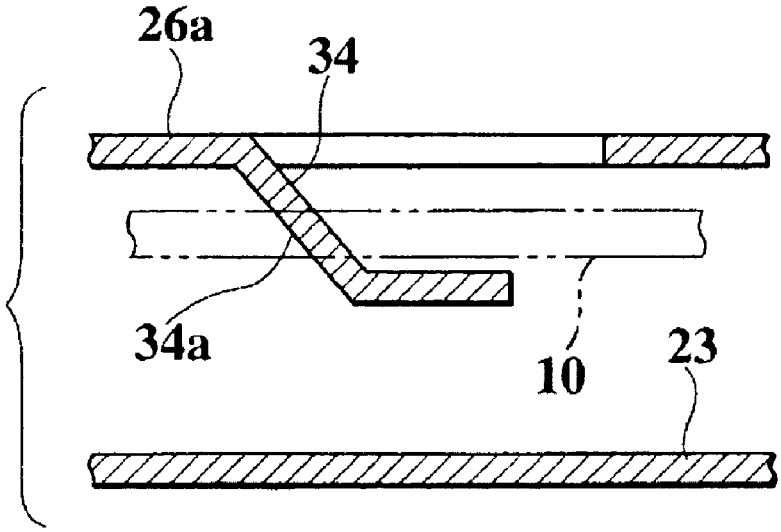
FIG. 6 is a sectional view illustrating a modification.

Further, in this embodiment, the direction of the stopper 34 extending downward is set to be a vertical direction with respect to the bottom wall 23 as illustrated in FIG. 5. However, as illustrated in FIG. 6, the extending direction may be set to an inclined direction as viewed with respect to the bottom wall 23. If setting the extending direction like this, the area of contact between the stopper 34 and the male terminal 10 becomes large. As a result of this, the pressing force per unit area that the member on each side receives becomes small and this can prevent the deformation, etc. of each member.

Additionally, according to the above-described embodiment, the engagement /retention portion has been constituted as above by the engaging/retaining protruding portion 30 while the engagement/retention portion to be engaged and retained has been constituted as above by the engaging/retaining hole 11. However, if the relevant structures only enable the both terminals to be engaged and retained together when inserting the male terminal, the expected purpose can be accomplished.

Additionally, according to the above-described embodiment, on the bottom wall 23 there has been provided the elastic contact portion 27 while on the upper wall 26*b* there has been provided the elastic receiving surface portion 33. However, it may be arranged that the elastic receiving surface portion 33 be provided on the bottom wall 23 while the elastic contact portion 27 is provided on the upper wall 26*b*.

Additionally, according to the above-described embodiment, a pair of the elastic contact portions 27 and the central elastic-deformation portion 29 have been provided as above by being divided so that each of them can be separately independently deformed elastically. However, the both may be integrated together. In the former case where the both have been provided in the divided way, however, the central elastic-deformation portion 29 is only needed to be elastically deformed when unlocking the engaging/retaining protruding portion 30 from the engaging/retaining hole 11. For this reason, the following merits exist. Namely, in the unlocking operation, there is no possibility of impairing the elasticity characteristic of a pair of the elastic contact portion 27 and therefore of obstructing the maintenance of a prescribed level of contact pressure. And in addition there also exists the following merit such as that attainable with the above-described embodiment. Namely, the elastic reinforcing portions 28 can be added to a pair of the elastic contact portion 27 to thereby provide a terminal that is excellent in terms of maintaining a prescribed level of contact pressure.

Deposit of Computer Program Listings

Not Applicable

What is claimed is:

1. A terminal comprising:

a bottom wall having two ends;

a pair of side walls that respectively rise from both ends of the bottom wall;

a pair of upper walls that extend from the side walls over the bottom wall, the upper walls opposing the bottom wall, the pair of upper walls comprises an upper-side upper wall and a lower-side upper wall disposed to partly overlap each other such that the upper-side upper wall regulates upward displacement of the lower-side upper wall;

an elastic contact portion that is freely elastically deformable in a direction substantially vertical with respect to the bottom wall, the elastic contact portion being provided on one of the bottom wall and the lower-side upper wall;

an elastic receiving surface portion that opposes the elastic contact portion, the elastic receiving surface portion being provided on the other of the bottom wall and the lower-side upper wall;

an engaging/retaining portion on the elastic contact portion that is freely displaceable by its elastic deformation made in a direction substantially vertical with respect to the bottom wall, the engaging/retaining portion being engaged with a mating terminal that is inserted between the elastic contact portion and the elastic receiving surface portion; and a stopper that is bent from the lower-side upper wall in order to prevent excessive insertion of the mating terminal, wherein a width of the stopper is larger than a thickness thereof, a width direction of the stopper is substantially the same as a direction in which the mating terminal is inserted, and the stopper is extended obliquely from the lower-side upper wall toward the bottom wall.

2. A terminal according to claim 1, wherein the stopper is bent integrally from the lower-side upper wall.

3. A terminal according to claim 1, wherein each of the upper-side and lower-side upper wall is bent from an upper end of one of the side walls.

* * * * *